US005450155A

United States Patent [19]

Carmen

[11] Patent Number: 5,450,155

[45] Date of Patent: Sep. 12, 1995

[54] REMOVABLE PROCESSING ASSEMBLY

[75] Inventor: Jerry Carmen, Spencerport, N.Y.

[73] Assignee: Eastman Kodak Company, Rochester, N.Y.

[21] Appl. No.: 254,802

[22] Filed: Jun. 6, 1994

[51] Int. Cl.[6] ..... G03D 13/02

[52] U.S. Cl. ..... 354/331; 354/336; 354/337

[58] Field of Search ..... 354/86, 88, 303, 304, 354/318, 319, 275, 276, 277, 280, 283, 284, 331–333, 336, 337; 206/455; 378/182, 188

[56] References Cited

U.S. PATENT DOCUMENTS

| | | | |
|---|---|---|---|
| 2,409,153 | 10/1946 | Russell et al. | 354/318 |
| 3,369,474 | 2/1968 | Callaghan | 15/104.94 X |
| 3,461,787 | 8/1969 | Pfaff | 354/310 |
| 3,507,204 | 4/1970 | Kohler, Jr. | 354/333 X |
| 3,667,361 | 6/1972 | Meggs et al. | 354/88 |
| 3,685,412 | 8/1972 | Lehmann | 354/304 X |
| 3,791,345 | 2/1974 | McCutcheon | 118/637 |
| 3,850,514 | 11/1974 | Land | 354/88 X |
| 4,307,955 | 12/1981 | Cocco et al. | 354/303 |
| 4,334,758 | 6/1982 | Leveille | 354/319 |
| 4,375,324 | 3/1983 | Holmes | 354/303 |
| 4,461,556 | 7/1984 | Douglas | 354/303 |
| 4,523,825 | 6/1985 | Norris | 354/318 X |
| 4,797,698 | 1/1989 | Uenaka et al. | 354/275 |

*Primary Examiner*—D. Rutledge

*Attorney, Agent, or Firm*—Cumpston & Shaw

[57] ABSTRACT

A developer cartridge for developing an imaging sheet includes a tray for holding a developer fluid, a fluid retaining pad in the tray, the pad having an upper surface for contacting the sheet, a cover movably attached to the tray for sealing the tray in a closed configuration, and movable to an open configuration exposing the upper surface of the pad for allowing a sheet to pass between the cover and the tray, and contact the pad.

18 Claims, 2 Drawing Sheets

REMOVABLE PROCESSING ASSEMBLY

FIELD OF THE INVENTION

This invention relates generally to processors for diffusion transfer prints, and more particularly to a removable wet chemical developer cartridge that can be used in a processor to simulate the characteristics of dry processing.

BACKGROUND OF THE INVENTION

Processors for "developing" peel-apart diffusion transfer prints commonly employ wet processing technology. That is, during the processing, the final print paper and the exposed, light sensitive donor material are laminated together to form a sheet which is presented to the developer. The developer wets the laminated sheet with chemicals, to transfer the image to the final print paper which are usually caustic. The chemicals develop the light sensitive sheet, which is subsequently dried, processed further if necessary, and delivered to the user.

In known processors, the user must periodically remove depleted liquid chemicals and replace them with fresh chemicals. Although the known wet chemical processors produce satisfactory prints, users prefer the convenience of dry processors, such as xerographic processors that do not require them to handle caustic liquid chemicals.

It is an object of this invention to provide a developer cartridge for moistening a laminated sheet with caustic chemicals in a chemical processor that is as convenient to use as the replaceable developer assemblies in dry processors.

It is another object of this invention to provide a wet chemical developer cartridge that does not expose the user to the wet chemicals under normal handling.

It is another object of this invention to provide a developer cartridge for carrying a processing solution that is made from reusable parts and recyclable materials that can be replaced easily by a user.

It is a further object of this invention to provide a developer cartridge that is sealed when not in use to inhibit spilling, evaporation, and crystallization of the processing fluids.

It is a still further object of this invention to provide a developer cartridge in which the liquid is applied to the laminated sheet by means of a pad, which pad is replaced when the chemicals are refreshed to reduce processing degradation due to chemical or dirt build up on the pad, and mechanical wear of the pad.

Briefly stated, and in accordance with a presently preferred aspect of the invention, a developer cartridge for developing an imaging sheet includes a tray for holding a developer fluid, a fluid retaining pad in the tray, the pad having an upper surface for contacting the sheet, a cover movably attached to the tray for sealing the tray in a closed configuration, and movable to an open configuration exposing the upper surface of the pad for allowing a sheet to pass between the cover and the tray, and contact the pad.

In accordance with another aspect of this invention, a pressure plate is provided in the cover for pressing the sheet against the pad.

In accordance with another aspect of this invention, a biasing member urges the tray and the cover to a closed position.

In accordance with a further aspect of this invention, the cartridge includes a seal between the tray and the cover for sealing the assembly when the cover is closed on the tray.

In accordance with a still further aspect of the invention, the cover includes a lifting attachment for lifting the cover to the open position when the cartridge is placed in a processor.

In accordance with a still further aspect of the invention, a removable clip closes the cover and the tray when the cartridge is not placed in a processor.

BRIEF DESCRIPTION OF THE DRAWING

The novel aspects of the invention am set forth with particularity in the appended claims. The invention itself, together with further objects and advantages thereof may be more readily understood by referring to the following detailed description of a presently preferred embodiment of the invention, taken in conjunction with the accompanying drawings, in which:

DETAILED DESCRIPTION OF THE INVENTION

The following description of a developer cartridge for a wet chemical processor is limited to the cartridge itself. The processor per se along with the elements thereof that expose the light sensitive material, laminate the light sensitive material to the final print paper, present the print paper to the developer cartridge of this invention, remove the print paper from the cartridge and delaminate and dry the final print are known and as such form no part of the invention, except in combination with the new developer cartridge.

Figure 1:
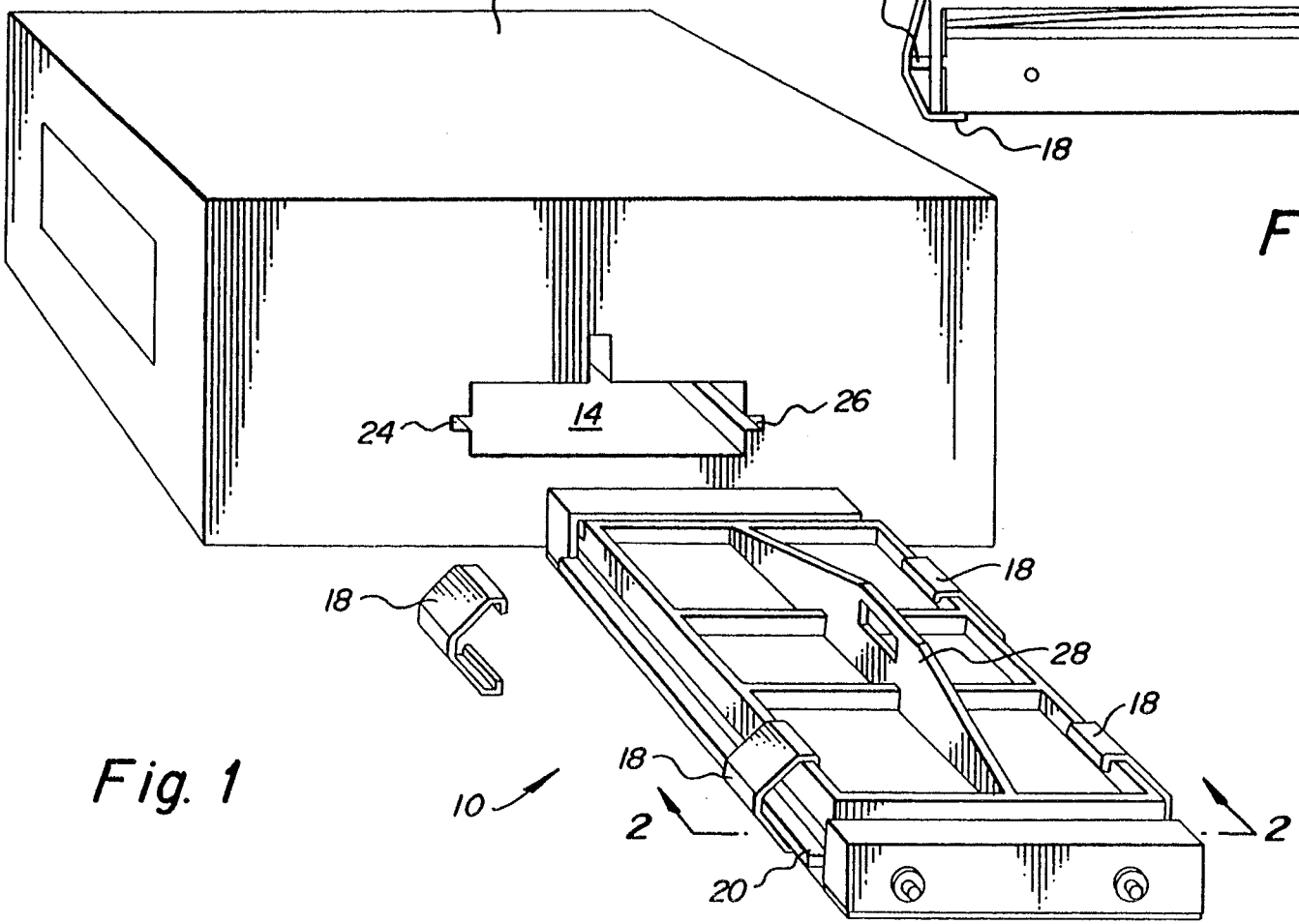
FIG. 1 is a perspective view of a developer assembly in accordance with this invention, and a processor for receiving the assembly.

Referring now to FIG. 1, the developer cartridge indicated generally at 10 is removably received in the processor 12 by sliding the cartridge into an appropriately shaped opening 14 in the side of the processor 12. Only the developer portion of the processor 12 is shown, it being understood that the processor receives the exposed light sensitive material, and print paper from an exposure station and paper supply station respectively, laminates the light sensitive material to the final print paper, and presents the laminated assembly to the processor along a paper path. After developing, the developed laminated sheet is delivered to a drying and separating station not shown, which dries and delaminates the sheet and presents the final print to the user.

Figure 2:
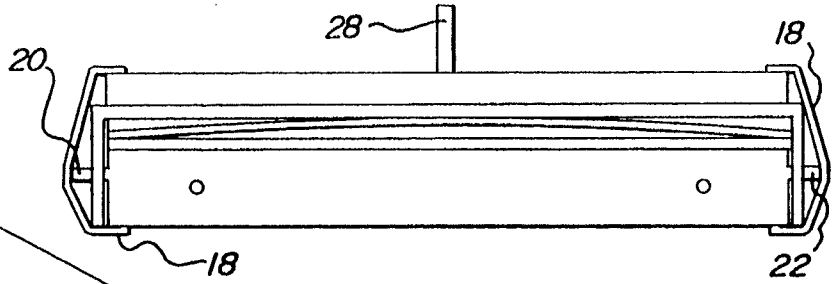
FIG. 2 is a cross-sectional view taken along lines 2—2 of FIG. 1.

As shown in FIGS. 1 and 2, one or more removable resilient clips 18 may be attached to the side of the developer cartridge 10 when the cartridge is not inserted in the processor for holding the cartridge in a closed configuration, as will be described in more detail shortly.

The cartridge 10 includes lateral guides 20, 22 (visible in FIG. 2) adapted to be received in corresponding slots 24, 26 in the opening 14 of the processor 12 for positioning and supporting the developer cartridge. A vertical lifting attachment 28 is received in an appropriately shaped vertical slot as the cartridge is inserted into the processor.

Figure 3:
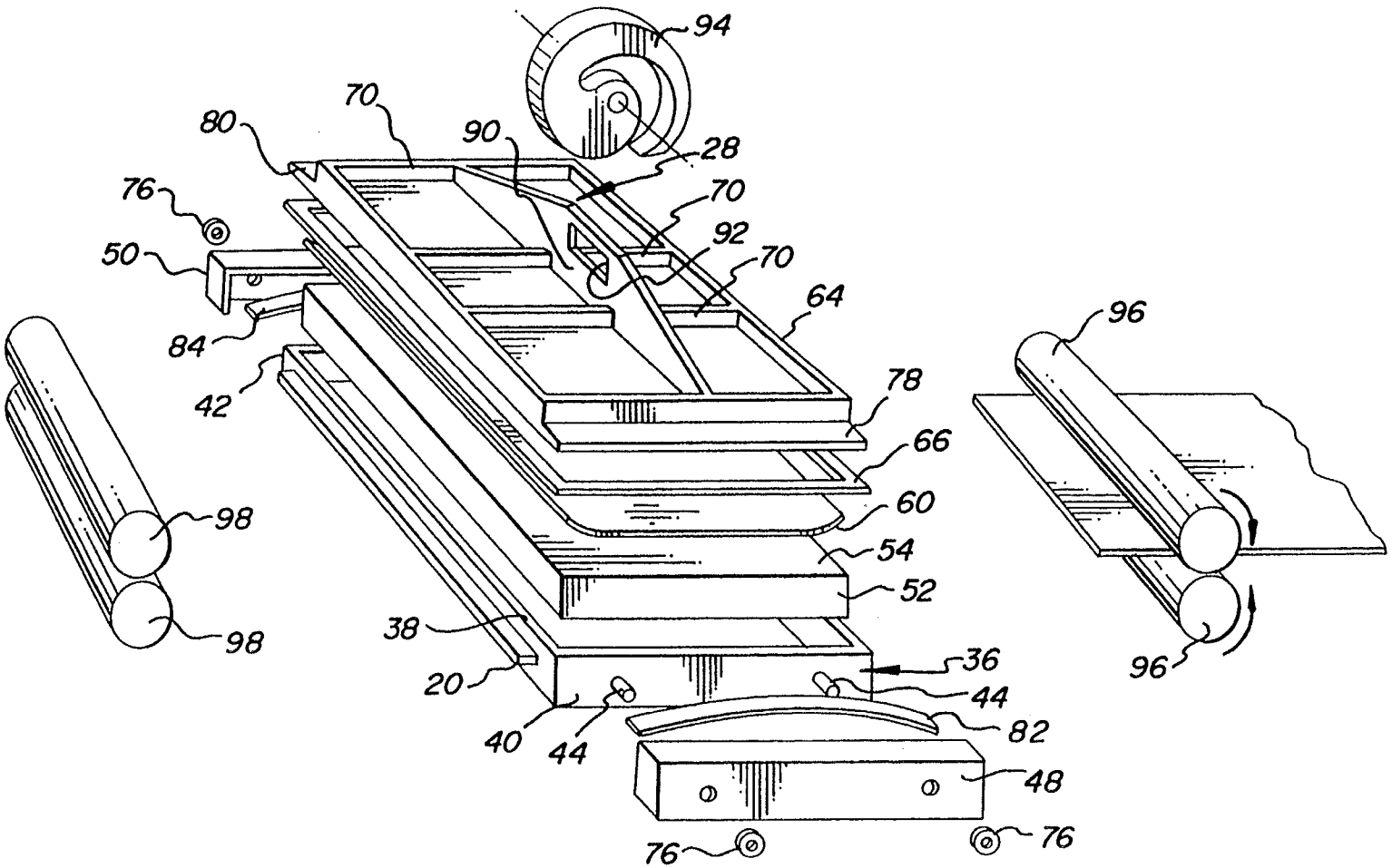
FIG. 3 is an exploded view of the developer assembly of the invention and the associated parts of the processor.

FIG. 3 shows the developer cartridge 10 of this invention in an exploded view in which all the elements of the cartridge can be seen and their method of operation understood.

The developer cartridge 10 includes a tray 36 that is preferably generally rectangular in configuration, and formed from a material such as high density plastic that is substantially impervious to the caustic chemicals carried by the tray. The tray 36 has first and second laterally projecting guide rails 20, 22(not shown in FIG. 3) for supporting the tray within the processor. The end surfaces 40, 42 of the tray are provided with a plurality of studs 44 for securing first and second end bells 48, 50 to the tray 36 for holding the cover closed, as will be described in more detail shortly. Preferably, the tray 36 is molded in one piece from a suitable plastic and includes a sealing surface 38 on an upper periphery for contacting the laminated sheet. The rails 20, 22 and studs 44 may be integrally molded with the tray, or manufactured separately and attached to the tray.

A generally rectangular liquid carrying pad 52, preferably an open cell foam pad, is disposed in the tray 36. Preferably, the pad 52 substantially fills the tray 36 and has an upper surface 54 projecting slightly above the sealing surface 38. The pad 52 may be formed from any material that is substantially impervious to the caustic chemicals used in processing, and which will not wear excessively by the passage of sheets over the tray.

A resilient pressure plate 60 is disposed over the pad 52 for urging the laminated sheet into contact with the upper surface 54 of the pad during processing to moisten the sheet with the developing fluid. The pressure plate 60 is preferably formed from a sheet of resilient material, formed into a slightly curved configuration at the edges to form a nip with the upper surface 54 of the pad 52, into which the laminated sheet may be pushed for processing. The pressure plate 60 is resilient enough to allow a cover 64 to close into a sealing configuration with the tray 36, as will be described later. The pressure plate 60 may be formed from a sheet of plastic material, stainless steel, or the like.

The reinforced cover 64 urges the pressure plate 60 into contact with the upper surface 54 foam pad 52, when the cover is closed. Preferably, the cover 64 is formed from a relatively stiff plastic material. The cover 64 is generally rectangular in configuration, and presents a generally flat surface to the pressure pad 52. A gasket 66 is attached to the periphery of the flat surface of the cover 64 for engaging the sealing surface 38 of the tray, when the assembly is closed.

The cover 64 includes a plurality of reinforcing ribs 70 for stiffening the cover, so that the cover will not flex excessively and the pressure pad 52 can exert a relatively uniform pressure on the laminated sheet, as it passes through the developer assembly.

The cover 64 is attached to the tray 36, and kept closed by the pair of end bells 48, 50 attached to the mounting studs 44 on the tray by a plurality of spring fasteners 76. The end bells 48, 50 are generally rectangular in configuration, and engage longitudinally projecting flanges 78, 80 on the ends of the cover 64 for aligning the cover on the tray 36 in its open and closed configurations.

First and second springs 82, 84, preferably leaf springs, are retained by the end bells 48, 50 and engage the longitudinally extending flanges 78, 80 of the cover 64 to urge the cover to a closed sealing engagement with the tray 36 when the developer cartridge is not inserted in the processor 12. The leaf springs 82, 84 may be made from metal, stiff plastic, or the like, curved into a conventional leaf spring configuration, having first and second ends engaging the end bells and curved surfaces engaging the flanges 78, 80.

The cover 64 includes a longitudinally arranged upwardly projecting dorsal fin 90 having an opening 92 therein for engaging a lifting cam 94. The lifting cam 94 rotates during operation of the processor 12 to lift the cover 64 from sealing engagement with the tray 36 to allow a laminated sheet to pass through the developer assembly.

In operation, the developer cartridge 10 is removed from its shipping container in the closed configuration, as shown in FIGS. 1 and 2. The safety clips 18 that hold the cartridge closed are removed. The cartridge remains closed, due to the action of the leaf springs. The side rails 20, 22 of the tray 36 are aligned with the slots 24, 26 in the processor, and the tray is slid into the processor. Within the processor 10, the tray 36 is positioned so that the lifting opening 92 is aligned with the lifting cam 94.

When a laminated sheet is ready for processing, the lifting cam 94 is rotated to raise the cover 64 with respect to the tray 36. A pair of input rollers 96 pushes the laminated sheet into the nip formed by the pressure plate 60 and top surface 54 of the foam pad 52. Developing chemicals carried by the pad 52 moisten the laminated sheet as it passes over the pad, and is held in contact therein by the pressure plate 60. When the sheet emerges from between the pad and the pressure plate 60, it is pulled from the developer by output rollers 98.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

Parts List:

10 . . . cartridge
12 . . . processor
14 . . . opening
18 . . . safety clips
20,22 . . . lateral guides
24,26 . . . slots
28 . . . lifting attachment
36 . . . tray
38 . . . sealing surface
40,42 . . . end surfaces
44 . . . studs
48,50 . . . end bells
52 . . . pad
54 . . . upper surface
60 . . . pressure plate
64 . . . cover
66 . . . gasket
70 . . . ribs
76 . . . fasteners
78,80 . . . flanges
90 . . . dorsal fin
92 . . . opening
94 . . . cam
96 . . . input rollers
98 . . . output rollers

What is claimed is:

1. A developer cartridge for a wet channel processor for developing an imaging sheet, comprising:
a tray for holding a developer fluid;
a fluid retaining pad in the tray, the pad having an upper surface for contacting the sheet;
a cover movably attached to the tray for sealing the tray in a closed configuration, and exposing the upper surface of the pad in an open configuration;
a pressure plate attached to the cover for pressing the sheet against the pad when the cover is open; and
attachment means for attaching the cover to the tray for resiliently maintaining the cover in the closed configuration.

2. The cartridge of claim 1 further comprising sealing means for sealing the cover with the tray when the cover is closed.

3. The cartridge of claim 2 in which the tray comprises a peripheral rim having a substantially flat upper surface; the cover comprises a substantially flat lower surface, and the sealing means comprises a gasket attached to one of the cover and the tray.

4. The cartridge of claim 1 in which the pressure plate comprises a curved plate of resilient material having first and second ends engaging the cover and a curved surface engaging the pad.

5. The cartridge of claim 4 in which the curved plate and the pad are arranged with respect to each other to form a nip into which a leading edge of the sheet may be fed for causing the sheet to pass between the pressure plate and the pad.

6. The cartridge of claim 1 in which the pad comprises an open cell foam pad.

7. A developer cartridge for a wet channel processor for developing an imaging sheet, comprising:
a tray for holding a developer fluid;
a fluid retaining pad in the tray, the pad having an upper surface for contacting the sheet;
a cover movably attached to the tray for sealing the tray in a closed configuration, and exposing the upper surface of the pad in an open configuration;
a pressure plate attached to the cover for pressing the sheet against the pad when the cover is open; and
an end bell attached to the tray for attaching the cover to the tray for resiliently maintaining the cover in the closed configuration.

8. The cartridge of claim 7 in which the cover comprises a flange extending into the end bell, and further comprising a spring in the end bell engaging the flange for urging the cover to the closed configuration.

9. The cartridge of claim 8 in which the spring comprises a leaf spring in the end bell having first and second ends engaging the end bell and a curved surface engaging the flange.

10. The cartridge of claim 7 in which the tray comprises stud means extending outwardly from an end wall of the tray for engaging the end bell.

11. A developer cartridge for a wet channel processor for developing in imaging sheet, comprising:
a tray for holding a developer fluid;
a fluid retaining pad in the tray, the pad having an upper surface for contacting the sheet;
a cover movably attached to the tray for sealing the tray in a closed configuration, and exposing the upper surface of the pad in an open configuration;
attachment means for attaching the cover to the tray for resiliently maintaining the cover in the closed configuration; and
a guide rail attached to a side wall of the tray and running longitudinally there along.

12. A developer cartridge for a wet channel processor for developing an imaging sheet, comprising:
a tray for holding a developer fluid;
a fluid retaining pad in the tray, the pad having an upper surface for contacting the sheet;
a cover movably attached to the tray for sealing the tray in a closed configuration, and exposing the upper surface of the pad in an open configuration; and
attachment means for attaching the cover to the tray for resiliently maintaining the cover in the closed configuration; and
a removable clip for engaging the tray and the cover for holding the cover in the closed configuration when the cartridge is not installed in the processor.

13. A developer cartridge for a wet channel processor for developing an imaging sheet, comprising:
a tray for holding a developer fluid;
a fluid retaining pad in the tray, the pad having an upper surface for contacting the sheet;
a cover movably attached to the tray for sealing the tray in a closed configuration, and exposing the upper surface of the pad in an open configuration;
attachment means for attaching the cover to the tray for resiliently maintaining the cover in the closed configuration; and
lifting means on the cover adapted to be engaged by a lifting member in the processor for lifting the cover from the closed configuration to the open configuration within the processor.

14. The cartridge of claim 13 in which the lifting means comprises a flange on the cover having an opening for receiving the lifting member.

15. A modular container for selectively presenting a fluid to a sheet, the container releasably retained in an image processor and moveable between an open position and a closed position, comprising:
a tray;
a foam pad sized to be retained in the tray and retain a quantity of the fluid;
a lid for contacting the tray to selectively close the container, the tray and the lid moveable between the open position for permitting passage of a sheet and the closed position for sealing the fluid from the ambient environment;
a biasing guide intermediate of the foam pad and the lid for urging the sheet against the foam pad; and
a basing member for urging the container to the closed position.

16. A modular container for presenting a fluid to a sheet of a given width in a processor, the processor having an opening mechanism for cooperatively engaging the container, the container moveable between an open operative position and a closed storage position, comprising:
an open tray for retaining a quantity of the fluid;
an open celled foam pad sized to be retained in the tray, the foam pad having a contact surface and a reservoir portion, the contact surface extending the given distance and the reservoir portion being sized to contact the fluid in the tray, wherein the porosity of the foam pad is sufficient to conduct the fluid from the tray to the contact surface;
a lid for contacting the tray to selectively close the container and form an air tight seal, the lid including an engagement portion for operatively engaging the opening mechanism to dispose the container in one of the open and the closed positions;

a biasing guide intermediate of the sponge and the lid for forming a line of contact with the contact surface for the given distance in the open position of the container; and a biasing member for urging the tray and the lid to the closed position.

17. The container of claim 16 wherein the biasing guide forms a curvilinear profile in the open position to form the contact line.

18. The container of claim 16 wherein the foam pad has a substantially planar contact surface.

* * * * *